United States Patent [19]

Lin

[11] 4,007,499

[45] Feb. 15, 1977

[54] COMMODE FLUSHING CONTROL APPARATUS

[76] Inventor: Teng Ke Lin, 2544 Berkshire Court, Waukegan, Ill. 60085

[22] Filed: Mar. 29, 1976

[21] Appl. No.: 671,899

[52] U.S. Cl. ..... 4/249; 4/108; 4/272; 49/263; 220/262; 251/295

[51] Int. Cl.[2] ..... E03D 5/08

[58] Field of Search ..... 4/67 R, 1, 249, 251, 4/70, 92, 108, 272, 87; 220/262, 263, 264; 49/263, 272; 251/295

[56] References Cited

UNITED STATES PATENTS

| | | | |
|---|---|---|---|
| 624,176 | 5/1899 | Chisholm | 4/249 |
| 718,971 | 1/1903 | Becker | 4/249 |
| 1,585,557 | 5/1926 | Miller | 4/249 |
| 1,614,346 | 1/1927 | Coret | 4/249 |
| 1,615,523 | 1/1927 | Shimo | 4/249 |
| 2,204,867 | 6/1940 | Rehback | 4/249 |
| 2,283,678 | 5/1942 | Landis | 4/251 |
| 2,467,019 | 4/1949 | Farson | 4/67 R |
| 2,679,651 | 6/1954 | Pokorny | 4/67 R |
| 3,624,845 | 12/1971 | Vorgang | 4/249 |
| 3,883,904 | 5/1975 | Wittman | 4/249 |

FOREIGN PATENTS OR APPLICATIONS

| | | | |
|---|---|---|---|
| 655,623 | 4/1929 | France | 4/249 |

*Primary Examiner*—Henry K. Artis
*Attorney, Agent, or Firm*—Bernard L. Kleinke

[57] ABSTRACT

Control apparatus used in connection with commodes automatically moves a trip lever for flushing the commode and includes a member adapted to be connected to the trip lever for moving between an initial position and a flushing position to cause the trip lever to raise a drain valve to its open position. A spring moves the member to its flushing position, and a person-operated device causes energy to be stored in the spring and releases subsequently the energy from the spring to move the member toward its flushing position. A latching device connected to the member connects releasably the member and the trip member for moving it and the valve against the force of water pressure acting on the valve until the water pressure equals the force applied by the spring after sufficient water discharge. As a result, the spring commences again to move the member after the sufficient water discharge has taken place to release the latching device so that the member becomes free of the trip lever and the flushing mechanism can complete its normal flushing operation.

10 Claims, 5 Drawing Figures

COMMODE FLUSHING CONTROL APPARATUS

The present invention relates to commode flushing control apparatus, and it more particularly relates to apparatus which causes the flushing of a commode after the user has departed therefrom.

There have been toilet flushing control apparatus, which enables the toilet to be flushed automatically once a person has departed therefrom. For example, reference may be made to the following U.S. Pat. Nos. 718,971; 1,135,028; 1,193,784,; 2,283,678; 2,628,363 and 3,134,986. While the devices shown and described in the foregoing patents may be suitable for some applications, it would be highly desirable to have apparatus for controlling the flushing of commodes, which apparatus may, if desired, be used as a kit to be installed on existing commodes. In this regard, it would be highly desirable to have commode flushing control apparatus which could be readily and conveniently installed on existing commodes, and which apparatus would operate in an efficient and in an economical manner. Such apparatus should readily lend itself to installation on existing toilets, as well as on existing urinals. Also, if the apparatus is desired to be used as a kit for installation on existing commodes, the apparatus should be able to be mounted completely on the outside of the commode to eliminate the problem of mounting it within the toilet tank, since such an installation could require additional openings in the tank, which openings may be subject to leaks. For example, reference may be made to the foregoing patents U.S. Pat. Nos. 1,135,028 and 2,628,363.

Therefore, the principal object of the present invention is to provide a new and improved commode flushing control apparatus, which may serve, if desired, as a kit to be installed on the outside of the commode.

Another object of the present invention is to provide such a new and improved commode flushing control apparatus, which is readily installed and efficient to use, while being inexpensive to manufacture.

Briefly, the above and further objects of the present invention are realized by providing commode flushing control apparatus, which includes a member adapted to be connected to the trip lever device of an existing toilet for moving between an initial position and a flushing position to cause the trip device to raise a commode drain valve to its open position, and a spring is provided for moving the member to its flushing position. A person-operated device stores energy in the spring and releases subsequently the energy from the spring to move the member toward its flushing position to open thereby the valve. A latching device connected to the member connects releasably the member and the trip lever device for moving it and the valve against the force of water pressure acting on the valve until the water pressure equals the force applied by the spring upon sufficient water discharge. As a result, the spring moves the member after the sufficient water discharge has taken place to release the latching device so that the member becomes free of the trip lever device and the flushing operation can be completed in a normal manner.

The invention, both as to its organization and method of operation, together with further objects and advantages thereof will best be understood by reference to the following detailed description taken in connection with the accompanying sheet of drawings, wherein.

Figures 1, 2, 3, 4, 5:
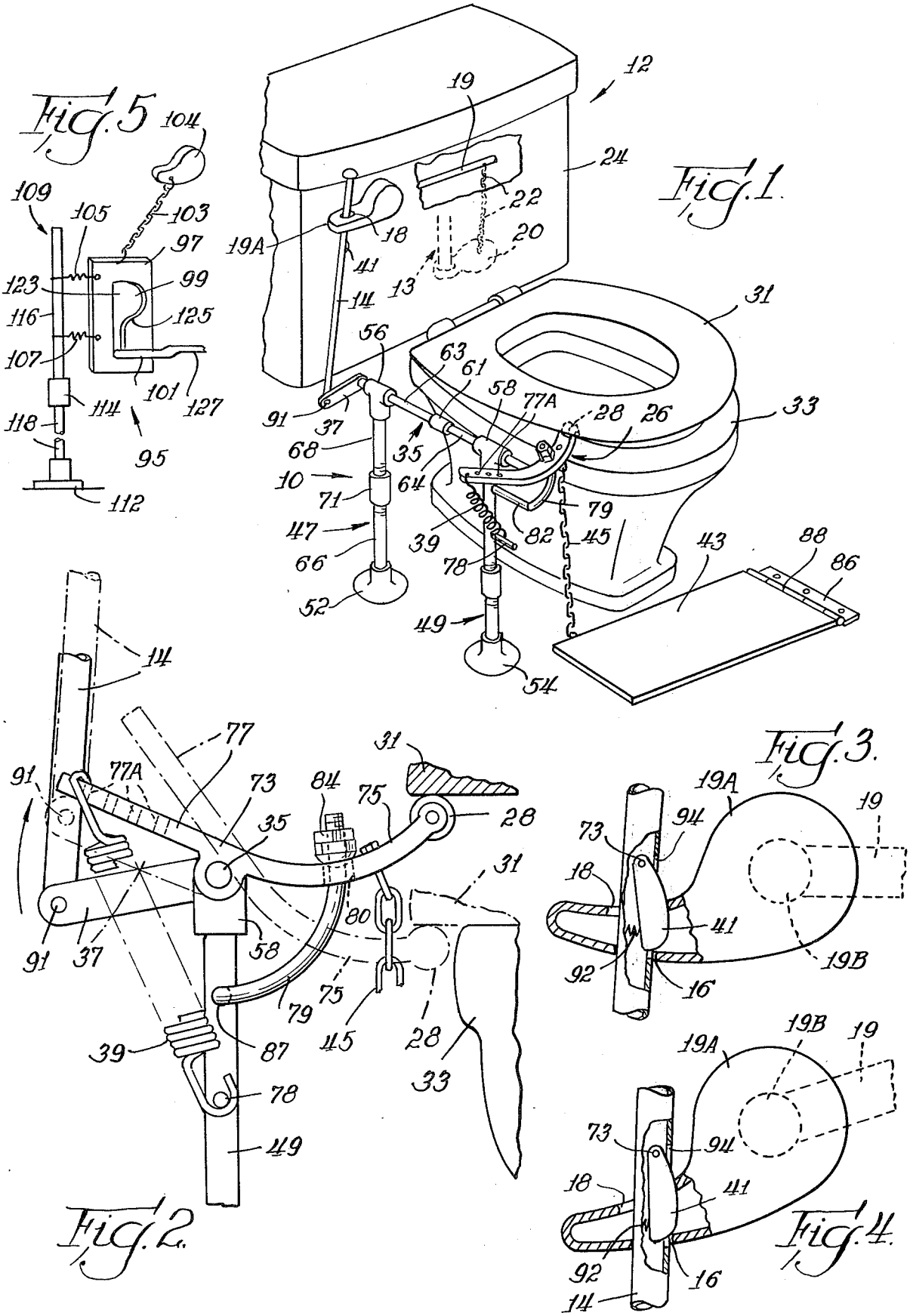
FIG. 1 is a pictorial view of flushing control apparatus for a toilet, which apparatus is constructed in accordance with the principles of the present invention.
FIG. 2 is an elevational view of the apparatus of FIG. 1.
FIG. 3 is an enlarged view of a portion of the apparatus of FIG. 1 illustrating the connection with the trip lever handle of the toilet.
FIG. 4 is a view which is similar to the view of FIG. 3, illustrating the trip lever handle in a progressive position during a flushing operation.
FIG. 5 is a fragmentary view of another flushing control apparatus, which is also constructed in accordance with the present invention.

Referring now to the drawings, and more particularly to FIGS. 1, 2, 3 and 4 thereof, there is shown a flushing control apparatus 10, which is constructed in accordance with the present invention and which is connected to a toilet 12 for controlling the flushing mechanism 13 thereof. While the apparatus 10 is illustrated and described in connection with a toilet, it is to be understood that such an apparatus could also be used in connection with a urinal. Also, it will become apparent to those skilled in the art that the apparatus of the present invention may also be incorporated into a new commode, rather than as a kit which may be used in connection with existing commodes as shown and described herein. The apparatus 10 generally comprises an upright rod or link 14 which extends through a pair of vertically aligned holes 16 and 18 (FIGS. 3 and 4) of a pivotally mounted handle 19A of a trip lever 19 having a chain 22 extending from the opposite end thereof in the toilet tank 24 to a floating drain valve 20 of the flushing mechanism 13, and a curved crank or lever 26 having a roller 28 engaging the underside of the toilet seat 31 above the toilet bowl rim 33. A horizontally disposed rotatably-mounted rod 35 extends from the front to the rear of the toilet seat 31, the curved crank 26 being fixed to the rod 35 for rotating it when a person sits on the toilet seat 31 to push the roller 28 downwardly. A link 37 is connected to the rear end portion of the rod 35 to the bottom end portion of the rod 14 so that when a person sits on the toilet seat 31, the rod 35 rotates to cause the rod 14 to be elevated upwardly through the holes 16 and 18. As shown in FIGS. 1 and 2 of the drawings, a coil spring 39 is stretched by the curved crank 26 when a person sits on the toilet seat 31 to rotate the rod 35 in a counterclockwise direction as viewed in FIG. 2 of the drawings. A spring loaded cam latch 41 is mounted on the upper portion of the rod 14 to connect the rod 14 to the handle 19A for flushing purposes. A spring biased platform 43 mounted on the floor in front of the toilet 12 is connected to the curved crank 26 by means of a chain 45 to serve as an alternate person-operated mechanism for causing the flushing mechanism 13 to be operated when a person first stands on the platform 43 and then steps off of it as hereinafter described in greater detail.

Considering now the apparatus 10 in greater detail with reference to the drawings, a pair of standards 47 and 49 as shown in FIG. 1 of the drawings supports the rod 35 and includes a pair of foot brackets 52 and 54, respectively, which are adapted to be fixed to the floor adjacent the toilet 12. Upper bearing sleeves 56 and 58 fixed to the top portion of the respective standards 47 and 49 receive and rotatably mounted the rod 35 so that it can rotate freely about its axis.

The rod 35 includes a turnbuckle 61 which threadably connects a pair of axially aligned rods 63 and 64 so that the spacing between the standards 47 and 49 may be adjusted to accommodate different size toilets. Similarly, the standards 47 and 49 are vertically adjustable to accommodate various different heights of toilet seats. In this regard, the two standards 47 and 49 are similar to one another and therefore only the standard 47 need now be described. The standard 47 generally comprises a pair of rods 66 and 68 which are threadably joined in axial alignment with one another by means of a turnbuckle 71 so that the overall height of the standard 47 may be adjusted by adjusting the turnbuckle 71.

Considering now the curved crank 26 in greater detail, the crank 26, as best seen in FIG. 2 of the drawings, is generally J-shaped with its intermediate portion 73 fixed to the rod 35 by any suitable technique, such as be welding. A front upwardly curved portion 75 includes the roller 28 at its distal end portion, and a rear portion 77 of the crank 26 has one end of the spring 39 fixed thereto, the opposite end of the spring 39 being fixed to the standard 49 at 78. As a result, the crank 26 may rotate about the axis of the rod 35 against the force of the spring 39 so that the rod 35 may rotate in clockwise direction as viewed in FIG. 2 of the drawings to a position shown therein in broken lines. When a person permits the crank 26 to return to its normal position as shown in solid lines in FIG. 2 of the drawings, the spring 39 retracts to cause the crank 26 to move in a counterclockwise direction as shown in FIG. 2 of the drawings. In order to limit the counterclockwise return movement of the crank 26, a curved member 79 fixed at its lower ends to the standard 49 has an upper end portion which extends through a hole 80 in the crank 26 between the roller 28 and the rod 35, the lower end portion of the curved member 79 being fixed to a short horizontal rod 82 as best seen in FIG. 1 of the drawings, and the upper end portion of the curved member 79 having an enlarged upper distal end portion 84 which serves as a stop for the crank 26.

Considering now the platform 43 in greater detail, the platform is in the form of a rigid sheet of material, such as wood or metal, and it is hingedly connected to a floor strip 86 which is adapted to be fastened to the floor adjacent the front portion of the toilet 12. A hinge 88 interconnects the platform 43 and the floor strip 86, and the lower end of the chain 45 is fastened to the end portion of the platform 43 opposite the hinge 88. The length of the chain 45 is adjusted so that when the crank 26 is in its normal position as shown in solid lines in FIG. 2 of the drawings, the end portion of the platform 43 is spaced above the floor. As a result, when a person steps onto the platform 43, the body weight exerts a force on the chain 45 to cause the crank 26 to rotate in a clockwise direction as shown in FIG. 2 of the drawings since the upper end of the chain 45 is attached to the crank 26 between the roller 28 and the rod 35.

Considering now the link 37 in greater detail, the link 37 is fixed at one of its ends to the rear end portion of the rod 35, and it is pivotally connected at 91 at its opposite end to the lower distal end portion of the upstanding rod 14. Thus, when the horizontal rod 35 rotates in a counterclockwise direction as viewed in FIG. 2 of the drawings, the link 37 also rotates in a counterclockwise direction to move the upstanding rod 14 in an upward direction.

In the normal position as shown in FIGS. 1 and 2 of the drawings, the link 37 is disposed in a substantially horizontal position extending from the left of the horizontal rod 35. In such a position, the upstanding rod 14 extends from the link 37 upwardly and slightly toward the right as viewed in FIG. 2 of the drawings to the handle 19A.

As shown in FIG. 1 of the drawings, the spring loaded cam latch 41 extending from the upstanding rod 14 is normally positioned below the handle 19A prior to a flushing operation. When a flushing operation occurs, the rod 14 is moved upwardly through the aligned holes 16 and 18, and the spring loaded cam latch 41 is able to pass through both of the upper and lower holes 18 and 16 in the handle 19A. In order to permit this, a spring 92 urges the latch 41 to pivot about a point 93 out of the tubular rod 14 through an opening 94 therein. As a result, as the rod 14 moves upwardly through the holes 16 and 18, the latch 41 pivots about the point 93 into the rod 14, thus compressing the spring 92.

When a person leaves the toilet 12, the rod 14 moves downwardly until the latch 41 engages the handle 19A as shown in FIG. 3 of the drawings. Due to the shape of the cam latch 41 and due to the angle at which the rod 14 passes through the holes 16 and 18, the latch 41 causes the rod 14 to be connected releasably to the handle 19A by engaging the underside portion of the handle 19A at the lower hole 16, whereby the handle 19A is pulled downwardly and pivoted about its pivoted point 19B. The rod 14 continues to pivot the handle 14A in a counterclockwise direction as viewed in FIG. 4 of the drawings until the water pressure acting on the valve 20 is substantially equal to the force exerted on the horizontal rod 35 by the spring 39. At this point, (the position illustrated in FIG. 4), the handle 19A stops moving and water discharges from the tank 24.

When sufficient water has discharged from the tank 24 to relieve the pressure acting on the valve 20 through the chain 22 to the trip lever 19, the spring 39 acting on the crank 26 continues to move the rod 14 downwardly, and the continued downward movement of the rod 14 causes the cam latch 41 to pivot inwardly still further. Once the cam latch 41 pivots inwardly for a sufficient amount to permit the latch 41 to slip through the lower hole 16, the rod 14 becomes free of the handle 19A and thus returns to its initial position as shown in FIGS. 1 and 2 of the drawings. Also, the handle 14A can then return to its normal position as shown in FIG. 1 of the drawings. The floating valve 20 continues to remain open as in conventional operations until the tank 24 is empty. Thereupon, the valve 20 falls into its closed position.

As shown in FIGS. 3 and 4 of the drawings, the upper hole 18 is substantially larger than the lower hole 16, which is only slightly larger than the rod 14. In order to adjust the tension on the spring 39, a series of openings or holes 77A in the rear portion 77 of the crank 26 receive individually the upper end of the spring 39 so that the spring tension may be adjusted by selecting the proper hole for receiving the end of the spring. Other adjustment techniques may be incorporated, such, for example, as employing a turnbuckle (not shown) to adjust in a continuous manner the length of the rear portion 77. It should be understood that the tension on the spring 39 should be selected to retain the valve 20 in its open position for a sufficiently long period of time, or else the valve 20 tends to fall back into its closed position.

Referring now to FIG. 5 of the drawings, there is shown a commode flushing control apparatus 95, which is similar to the apparatus 10 and which is also constructed in accordance with the present invention. The apparatus 95 is similar to the apparatus 10, except that the apparatus 95 does not employ the link 37 and the upstanding rod 14. In their place, the apparatus 95 includes a plate 97 having a cut-out opening 99 for receiving a follower rod 102, which has its rear end portion connected to the horizontal rod (not shown) similar to the horizontal rod 35 of the apparatus 10 in a similar manner as the link 37 is connected to the rod 35. A chain 103 connects the upper portion of the plate 97 to a trip lever handle 104 which is similar to the trip lever handle 19A.

A pair of springs 105 and 107 connect the side edge of the plate 97 to a standard 109, which is similar to the standards 47 and 49 of the apparatus 10. As a result, the plate 97 is supported by the handle 104 via the chain 103 and by the standard 109 via the springs 105 and 107.

The standard 109 includes a foot bracket 112, which is adapted to be attached to the floor. In order to enable the standard 109 to be adjustable in height, a turnbuckle 114 interconnects a pair of rods 116 and 118 in axial alignment.

The opening 99 includes a vertical elongated opening portion 121 and an enlarged upper opening portion 123, the lower portion of which is defined by a knee or latching shoulder 125.

The follower rod 101 is in the form of a loop to link with the plate 97 through its opening 99. The loop has an extension 127 which is fixed to and extends transversely from the spring-biased horizontal rod (not shown) similar to the horizontal rod 35 of the apparatus 10. When the horizontal rod rotates, the follower rod 101 swings upwardly and follows the contours of the opening 99 until the rod is positioned within the upper opening portion 123.

When the user leaves the toilet, the spring-biased horizontal rod starts to return to its normal position and thus rotates the handle downwardly to open a floating drain valve (not shown) of a flushing mechanism (not shown) to commence the flushing operation. As indicated by the broken lines in FIG. 5, the follower rod 101 stops at the lower portion of the enlarged upper opening portion 123 and remains there temporarily when the water pressure on the floating valve, similar to the valve 20 of FIG. 1, equalizes with the spring force acting on the horizontal rod.

Thereafter, the water continues to discharge until the water pressure acting on the floating valve reduces sufficiently to permit the spring-biased horizontal rod to return to its initial position and thus the follower in FIG. 5 of the drawngs. Whereupon, the handle 104 is permitted to return to its normal position as shown in FIG. 5. The floating valve then remains open until all of the water has been discharged as in conventional flushing operations.

While the present invention has been described in connection with particular embodiments thereof, it will be understood that many changes and modifications of the invention may be made by those skilled in the art without departing from the true spirit and scope thereof. For example, the apparatus of the present invention may be incorporated inside of a new commode in an inconspicuous manner as may become apparent to those skilled in the art. Accordingly, the appended claims are intended to cover all such changes and modifications as fall within the ture spirit and scope of the present invention.

What is claimed is:

1. Apparatus for controlling commode flushing mechanisms having a drain valve and valve trip device for raising the drain valve to its open position for water discharge purposes, comprising:

connecting means adapted to be connected to the trip device for moving between an initial position and a flushing position to cause the trip device to raise the drain valve to its open position;

spring means for moving said connecting means to its flushing position;

person-operated means attached to said connecting means for storing energy in said spring means and for releasing subsequently the energy from said spring means to move said connecting means toward its flushing position to open the valve;

latching means connected to said connecting means for attaching releasably said connecting means and said device for moving it and the valve against the force of water pressure acting on the valve until the water pressure acting on the valve equals the force applied by the spring means upon sufficient water discharge, whereby said spring means moves said connecting means after sufficient water discharge has taken place to release said latching means so that said connecting means becomes free of the trip device and the flushing mechanism can complete its normal flushing operation.

2. Apparatus according to claim 1, wherein said spring means includes a rotatably mounted rod having a crank connected to one end portion thereof and having a spring, said spring being stretched when said rod is rotated.

3. Apparatus according to claim 2, wherein said person-operated means includes a distal end portion adapted to extend under and engage the underside of the toilet seat above the toilet bowl rim.

4. Apparatus according to claim 2, wherein said person-operated means includes a spring-loaded platform, a member interconnecting said platform and said crank.

5. Apparatus according to claim 1, wherein said connecting means includes a rod extending through an opening in a handle portion of the valve trip device, said latching means including a spring loaded camming member connected to said rod.

6. Apparatus according to claim 1, wherein said spring means includes a rotatably mounted rod adapted to be mounted adjacent a commode on the outside thereof, said rod being supported by a plurality of standards.

7. Apparatus according to claim 6, wherein each one of said standards is vertically adjustable.

8. Apparatus according to claim 6, wherein the length of said rod is adjustable.

9. Apparatus according to claim 1, wherein said connecting means includes a plate having an opening therein and follower means extending therewithin.

10. Apparatus according to claim 9, wherein said opening includes a vertical elongated opening portion with an enlarged upper opening portion, said latching means including the lower portion of said enlarged upper opening portion being defined at least partially by a latching shoulder.

* * * * *